US008535447B2

(12) United States Patent
Drew

(10) Patent No.: US 8,535,447 B2
(45) **Date of Patent: *Sep. 17, 2013**

(54) METHOD AND SYSTEM TO STABILIZE AND PRESERVE ION ARTIFACTS

(75) Inventor: Michael J. Drew, Clemson, SD (US)

(73) Assignee: Clemson University Research Foundation, Clemson, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/330,104

(22) Filed: Dec. 19, 2011

(65) Prior Publication Data

US 2012/0152287 A1 Jun. 21, 2012

Related U.S. Application Data

(63) Continuation of application No. 11/385,296, filed on Mar. 21, 2006, now Pat. No. 8,080,110.

(51) Int. Cl.
*C23G 1/14* (2006.01)
*C23F 11/06* (2006.01)
*B08B 3/08* (2006.01)
*B08B 3/10* (2006.01)

(52) U.S. Cl.
USPC ..... 134/2; 134/19; 134/42; 422/7; 422/13

(58) Field of Classification Search
USPC ..... 134/2, 16, 17, 42
See application file for complete search history.

(56) References Cited

U.S. PATENT DOCUMENTS 6,352,644 B1 * 3/2002 Hawthorne et al. ..... 210/643

OTHER PUBLICATIONS

Hamilton, D.L.; Methods of Conserving Archaeological Material form Underwater Sites; Jan. 1, 1999.*

* cited by examiner

*Primary Examiner* — Michael Kornakov
*Assistant Examiner* — Natasha Campbell
(74) *Attorney, Agent, or Firm* — J. Bennett Mullinax, LLC

(57) ABSTRACT

A method, system and device to use a dilute alkaline solution held at sub-critical temperature and pressure conditions to remove rapidly chloride ions from corroded iron artifacts.

4 Claims, 10 Drawing Sheets

METHOD AND SYSTEM TO STABILIZE AND PRESERVE ION ARTIFACTS

PRIOR APPLICATION AND PRIORITY

This application claims priority of U.S. Provisional Patent Application No. 60/664,083 filed Mar. 22, 2005 by Michael J. Drews and titled Method and System to Stabilize and Preserve Metal Artifact.

FIELD OF THE INVENTION

The invention is generally in the field of methods and devices to stabilize artifacts recovered from a marine or terrestrial environment. More specifically, the invention is directed towards a method and device to remove more effectively and rapidly chloride ions from iron corrosion products, thereby reducing the rate and extent of subsequent corrosion of the artifact. The device and associated method find specific application in the stabilization and preservation of archeological artifact recovered from salt water environments.

BACKGROUND OF THE INVENTION

Post-excavation corrosion remains a significant consideration in the stabilization and preservation of archeological artifacts. A major consideration is removal of chloride ion, a major factor in the corrosive process.

Corrosion in its simplest form is deterioration of metal by oxidation and, is commonly recognized as rusting, expressed chemically as $$4Fe(solid)+3O_2(gas)\text{->}2Fe_2O_3.H_2(solid)$$

The process of corrosion or rust can be explained in terms of electro-chemical mechanisms in which a water droplet constitutes a minute galvanic cell with defined anode and cathode regions. Electrons flow from the anode to the cathode through the metal, and ions flow through the water droplets. As one of average skill in the art recognizes, this electrochemical model provides a clear explanation as to why the presence of dissolved salts (particularly the $Cl^{-1}$ ion) accelerates corrosive processes.

Corrosive processes are a widely acknowledged nemesis of archeologists, particularly those dedicated to finding and preserving marine artifact. In recent decades, technology to locate, identify, and recover historic remains of ships and aircraft lost in combat; by accident, or as a result of storms has exploded. The discovery of the remains of the "Titanic" in the North Atlantic Ocean in September, 1988, 73 years after she sank in about 12,500 feet of water, and the subsequent recovery of about 1800 artifacts from the wreckage ignited interest in the recovery/preservation of marine artifacts. The hull of the Titanic showed expected devastation from corrosive forces; much of the recovered artifact was porcelain and material not as subject to such forces. None-the-less, recovery of iron artifact that is highly susceptible to corrosion is of continuing interest.

In May, 1995, after decades of futile searching, a small group of divers located the hull of the Confederate submarine, "H.L. Hunley," in less than 40 feet of water in the Atlantic Ocean, immediately outside of the Charleston, S.C. harbor. In February 1864, following a historic, successful attack on the Union ship "Housatonic," the "Hunley" and her full crew were lost.

The hull of the "Hunley" was, as expected, badly corroded and fragile. See FIG. 1. In order to preserve the priceless, historic, iron artifact devices and methods to minimize continued losses and to preserve and stabilize the recovered hull and associated artifact became of immediate concern. Prior art addresses corrosion prevention, but fails to address preservation and stabilization of iron artifact.

For example, U.S. Pat. No. 2,490,062 issued Dec. 6, 1949 to Jernstedt was, "to provide for producing protective coatings on metal surfaces ***". The metal surfaces included iron, zinc, and aluminum. The coatings were to protect against rust formation, not to stabilize rusted artifact.

Later, U.S. Pat. No. 3,961,991 issued Jun. 8, 1976 to Yoshida and Takagi indirectly addressed corrosion prevention in describing a pretreatment of large metal surfaces, such as the hull of a ship, to prepare the surface for coating with a rust inhibiting coating. Again, the emphasis is on prevention.

In at least one patent, the marine environment is recognized as a major cause of corrosion. U.S. Pat. No. 4,844,865 issued Jul. 4, 1989 to Shimada and Sakakibara recognized salt water itself, and corrosion caused by sea salt particles as the principal causes of the decay of steel structures. The '865 patent relates to "non-magnet steel material" for use in magnetic floating high-speed railways nuclear fusion facilities, and similar applications. In the '865 patent, the issue of corrosion resistance is addressed by the development of special materials, not by prevention as described above or by stabilization of artifact.

U.S. Pat. No. 4,950,453 issued to Murray on Aug. 21, 1990 discloses and claims a method of passively forming a layer of zinc silicate on metal surfaces to protect the surfaces from corrosion. The metal surface to be protected is pretreated with a very dilute solution of a soluble zinc salt And ultimately the treatment leads to the formation of a protective coating of zinc silicate. U.S. Pat. No. 6,468,364 issued Oct. 22, 2002 to Marecic describes an anticorrosion treatment utilizing a zinc/aluminum alloy coating with a molybdenum/phosphoric acid solution.

U.S. Pat. No. 5,849,220 issued Dec. 15, 1998 to Batton and Chen provides a corrosion inhibiting composition adapted for use in both aqueous and non-aqueous fluid involving both ferrous-containing and non-ferrous containing metals. The composition consists of two surfactants, a sorbitan fatty acid ester and a polyethylene derivative. Although markedly different from the '453 patent, like the '453 patent, the '220 patent depends on a specific protective layer to prevent corrosion.

Two related problems are addressed by U.S. Pat. No. 6,425,997 issued Jul. 30, 2002 to Johnson: removal of chloride ion from a corroded, pitted steel surface and measuring the amount of chloride present by use of a conductivity cell. The process claimed in the '997 patent to remove water soluble ions comprises placing a corroded surface in contact with deionized water while passing a high frequency waveform alternating current between steel anodes and the corroded metal surface (which serves as the cathode).

The preceding summary of U.S. patents is a representative summary of prior art that relates to corrosion prevention or management. Clearly, the major focus is on corrosion prevention of "new" material employing some type of protective coating. The '997 patent taught the significance of removal of chloride ions only from the use of electrolysis in highly specialized electrical conditions.

Interest continues to grow in preservation and stabilization of artifact recovered from marine environment and there remains room for innovation and improvement in methods and devices to preserve and stabilize such artifact by rapid and thorough removal of chloride ions.

BRIEF DESCRIPTION OF THE INVENTION

A primary purpose and goal of the invention is removal of chloride ions from archeological artifact recovered from marine environments.

An additional purpose and goal of the invention is the stabilization and preservation of archeological artifact recovered from marine environments.

A still further purpose and goal of the invention is a system and device to facilitate rapid and thorough removal of chloride ions from archeological artifact recovered from marine environments.

These and other purposes and goals can be achieved by a system to remove $Cl^-$ from corroded iron comprising an alkaline solution and a device having a high pressure cylinder with an interior length and cross-section area and shape suitable to receive and position an artifact to be exposed to the alkaline solution, a means to heat and maintain a prescribed temperature of the alkaline solution, a high pressure pump and related plumbing to deliver the solution into the cylinder to maintain a prescribed pressure, means to continuously circulate the heated solution, a backflow, pressure control device, and a heating jacket; and further by a method of stabilizing archeological artifact recovered from a marine environment comprising the following steps following recovery, cleaning the debris from the artifact by washing or soaking in water, positioning the artifact in the cylinder element of a device, preparing a dilute alkaline solution, heating the solution and filling the cylinder with the heated solution under pressure, maintaining the pressure and temperature at prescribed conditions for a prescribed period, cooling the alkaline solution and draining the cylinder, and removing the artifact from the cylinder; and further by a device comprising a high pressure cylinder capable of receiving and maintaining solutions and under pressure and of heating the solutions under pressure, and further capable of receiving and positioning an artifact to be treated with the solution, a heat jacket capable of heating the solution and maintaining the temperature, a pump capable of delivering the fluid under pressure, a feed supply reservoir, and backflow control means.

These and other features, aspects, benefits, and advantages of the present invention, including the best mode thereof, will become better understood and appreciated with reference to the following descriptions, figures, and appended claims.

EXAMPLES

Theory and Concepts

Figure 1:
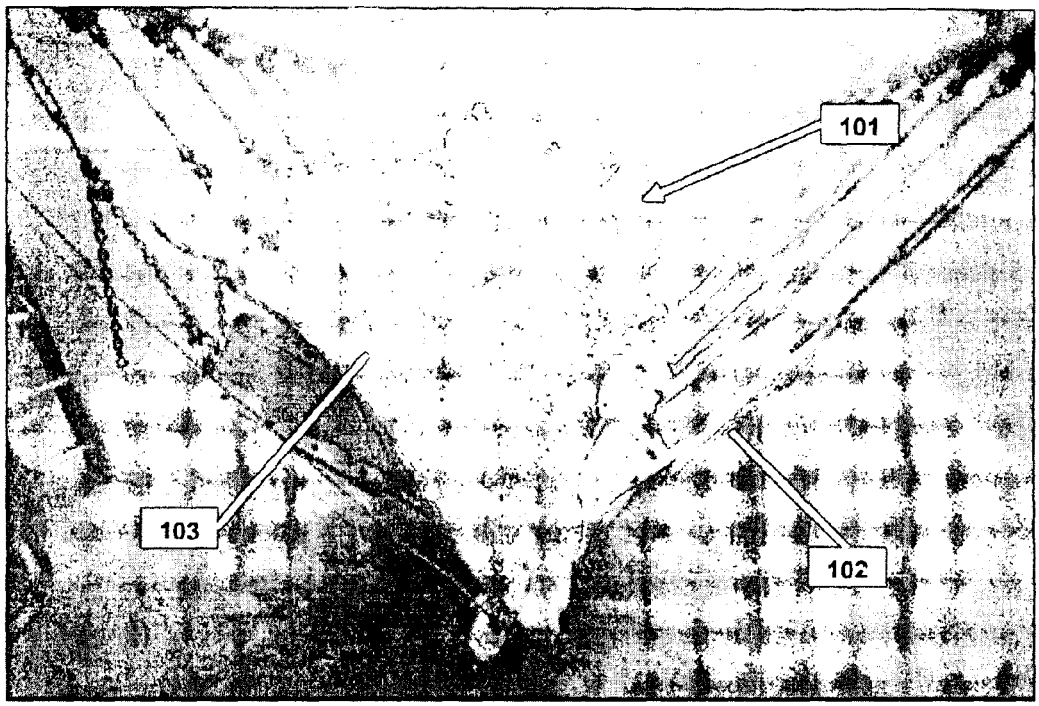
FIG. 1 is a photograph of the hull of the L. H. Hunley in a water preservation tank at Charleston, S.C.

Iron rust formed according to the equation $$4Fe(solid)+3O_2(gas)\text{->}2Fe_2O_3$$

is recognized as the reddish/brown crusted coating formed on the surface of unprotected iron. Although unsightly, this relatively insoluble material effectively forms a protective layer that can inhibit continued corrosion of the iron. In the presence of the chloride ion, $Cl^{-1}$, the situation changes. Chloride ions accelerate rusting and inhibit the formation and perpetuation of the protective crust on the surface of iron structures for several reasons—their high charge density, capacity to form soluble rust products, and their ability to enter an oxide film.

Chlorine is widely spread throughout the environment and common to the marine environment. The pores in the corrosion products of iron artifact recovered from marine environments are filled with solutions containing $Fe^{+2}$, $FeOH^{+1}$, and $H^{+1}$ ions, charges balanced by $Cl^{-1}$ ions, generally characterized as an acidic $FeCl_2$ solution. Under conditions in which the recovered artifact dry rapidly, the acidic $FeCl_2$ solution concentrates, the corrosion layer cracks, allowing oxygen to become more readily available, resulting in the rapid oxidation of the $Fe^{+2}$ ions in solution, a process described as oxidation and hydrolysis according to the equation $$4Fe^{+2}+O_2+6H_2O\text{<->}4FeOOH+8H^{+1}$$

Solid iron oxyhyrdroxides (FeOOH) precipatate, and the solution becomes more acidic, resulting in further corrosion of the remaining iron. Generation of the hydrogen ($H^{+1}$) ions results from the continued corrosion of iron. However, the anion responsible for the charge balance of the $Fe^{+2}$ and the $H^{+1}$ ions must be considered. The chloride $Cl^{-1}$ ion is the predominate anion in recovered marine (iron) artifact. The corrosion cycle, including the critical role of $Cl^{-1}$ may be summarized as $$2Fe(s)+4HCl(aq)+O_2(g)\text{<->}2FeCl_2(aq)+2H_2O$$

$$2FeCl_2(aq)+3H_2)+\tfrac{1}{2}O_2(g)\text{<->}2FeOOH(solid)+4HCl(aq)$$

in which s designates solid, aq designates aqueous, and g designates gaseous states. (See, Askey, et al. 1993. "The corrosion of iron and zinc by atmospheric hydrogen chloride." Corrosion Sci. 34:233-247).

Chloride containing compounds including akaganeite (B—FeOOH), hydrated ferrous chloride ($FeCl_2.2H_2O$ and $FeCl^2.4H_2$), and green rust, (a mixture of $Fe^{+2}$ and $Fe^{+3}$ hydroxide and oxyhydroxide of variable $Cl^{-1}$ content. In the corrosion layer of artifact excavated from a marine environment, the chloride ion may be (1) contained within solid corrosion products, (2) adsorbed on the surface of a solid corrosion product, or (3) present in active pores of the corrosion layer.

The presence of $Cl^{-1}$ affects the rate and extent of post-excavation corrosion of artifact recovered from marine environments. Effective stabilization and preservation of such artifacts require rapid and complete removal of chloride ions from cast and wrought iron artifact. The most commonly employed methods of prior art include soaking in NaOH and soaking in NaOH followed by electrolysis to remove chloride ions.

FIG. 1 illustrates the H.L. Hunley 101 supported on an extensive cradle system 102 in a preservation holding tank at facilities in Charleston, S.C. The extensive results of corrosion 103 is clearly visible encrusting the hull. Although currently maintained in a chlorine-free environment, concentrations of chloride ions from its oceanic environment continue to destroy this historic artifact.

The System

The following examples and illustrations describe a new system to remove $Cl^{-1}$ ions from iron artifact and demonstrate the efficacy of the system. Application of the system to remove chloride from a corroded iron artifact requires exposing the artifact to a heated solution of an alkaline solution under pressure. In the system, it is critical that the alkaline solution be heated under pressure, and that the solution be maintained at a specific pressure and temperature, thereby maintaining sub-critical water conditions for the solution.

The system comprises two major components: (i) a solution component—a dilute alkaline solution and (ii) a treatment device comprising a cylinder, capable of being pressurized and maintaining a specified pressure, in which artifacts to be preserved are positioned, a pressure pump, and a heating jacket that heats the pressurized solution and maintain specific temperature/pressure conditions such that the alkaline solution is maintained at a sub-critical water condition or state. The device also includes means of continuously circulating the solution in the heated, pressurized cylinder. This circulation may be accomplished as a function of the pump that delivers the solution to the cylinder, a separate, re-circulating pump, or an internal agitator. Except for case specific, design considerations, any means to circulate the solution that does not adversely affect the pressure/temperature control or the artifacts being treated is acceptable. As one skilled in the art appreciates, the system also includes necessary plumbing, pressure/temperature control and monitoring devices and technical instrumentation.

Figure 2:
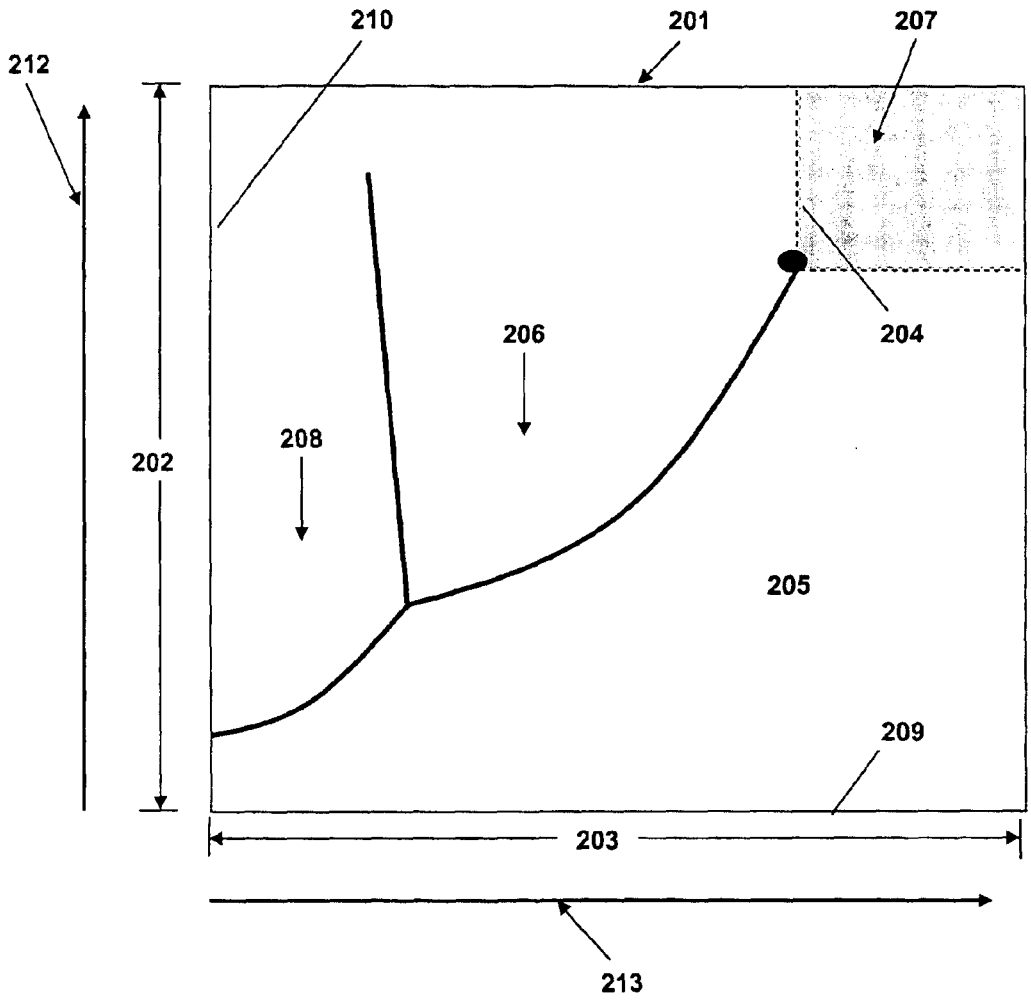
FIG. 2 illustrates the relation between pressure and temperature in relation to phases of water and its critical point.

By definition, sub-critical water is water held at the requisite pressure with the temperature between 212 F and 705 F (100 to 374 C). FIG. 2 illustrates 201 the relationship between pressure 102 increasing according to the arrow 212 from left to right, temperature 203 increasing horizontally according to the arrow 213, the phases of water from solid 208, to liquid 206, to vapor 205, with the critical limits of pressure 209 of 3,190 psi (or 220.5 bars) and temperature 210 are shown. Their intersection defines the critical point that establishes the limits of the super critical region 207.

The solution component of the system was either a 0.50% (w/w) solution of sodium hydroxide or a 1.00% (w/w) solution of ammonium hydroxide. Temperature of the solution was from 130 to 300 C, preferably 180 C, and pressure was above the prescribed subcritical temperature ranging from 600 to 800 psi (about 40 to 53 atm).

Figure 3:
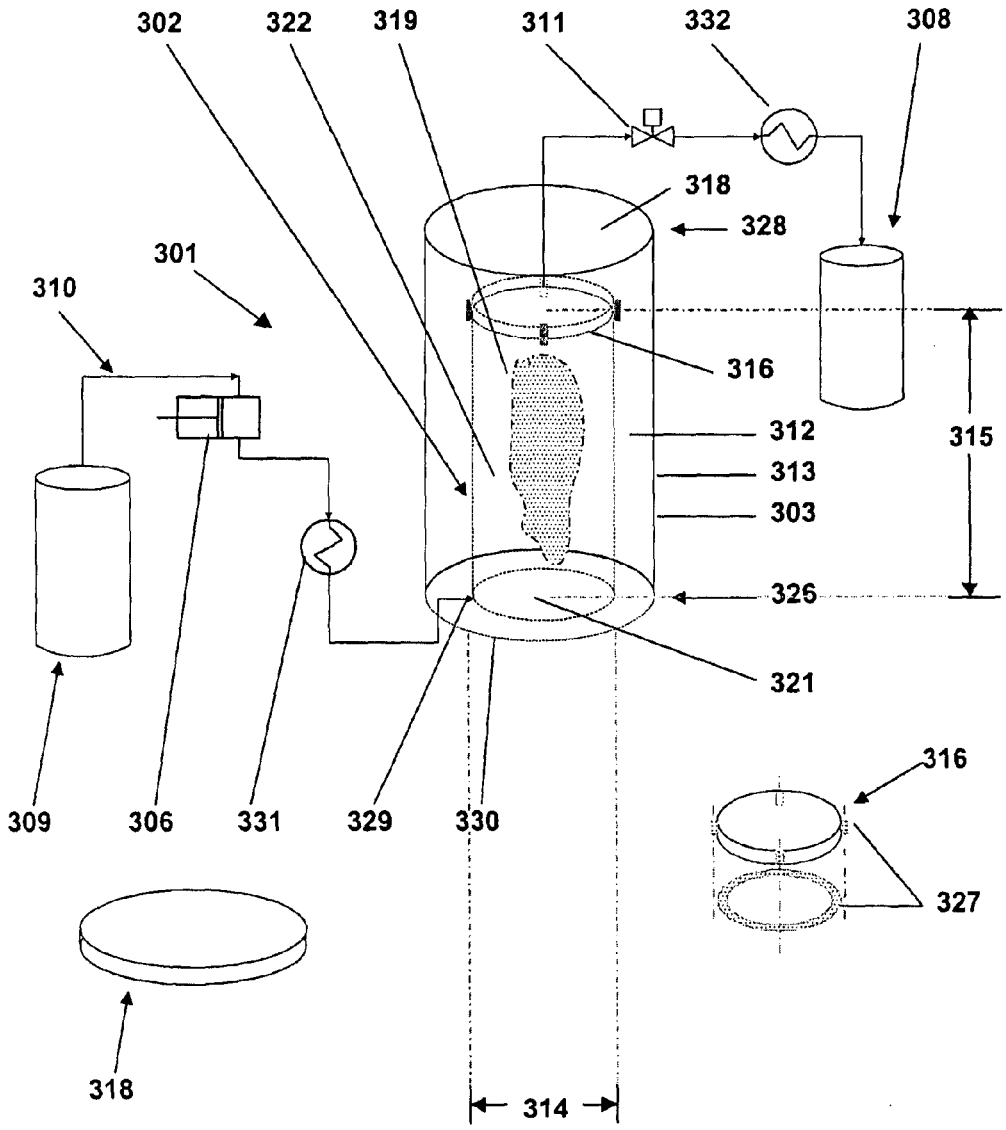
FIG. 3 is a schematic diagram of a device to treat recovered artifact with a heated alkaline solution under pressure.

The device element of the system by which the artifact from which the chloride is to be removed is exposed to the heated alkaline solution under pressure is illustrated in FIG. 3. The device 301 comprises a high pressure cylinder 302 with an open, central chamber 322 in which the artifact 319 to be treated is positioned. The distal end 326 of the high pressure cylinder 302 is closed by securely sealed cap element 321. The proximal end 328 of the high pressure cylinder 302 is closed and sealed by a removable end piece 316. The removable end piece 316 may be attached to the proximal end 328 of the high pressure cylinder 302 in a variety of ways, flanges with bolts as illustrated 327, or clamps, as one skilled in the art will understand. Regardless of the means of attachment, the removable end piece and proximal end of the high pressure cylinder 302 may interlock by a system of complimenting, rotating lugs to seal the removable end piece and high pressure cylinder. Although treatment with the alkaline solution is usually at less than 230 C and 1,000 psi, the high pressure cylinder is designed for effectively the limits of the critical point for water. Preferably, the high pressure cylinder is fabricated from stainless steel with appropriate technology to tolerate the anticipated pressure and temperature maximum limits.

The high pressure cylinder is encased in a heating jacket 303. In one configuration, the heating jacket 303 comprises a sleeve-like structure 313 in which the high pressure cylinder 302 is positioned. The space 312 between the sleeve element 313 and the outer wall of the high pressure cylinder 302 is filled with material capable of being uniformly heated and of transferring heat to the alkaline solution with which the high pressure is filled and of maintaining the specified temperature for the solution throughout the course of the treatment.

The distal end 326 of the sleeve element 313 is closed with and sealed with a bottom cover 330. The proximal end 328 is sealed with a removable cover 318. The sleeve element 313, bottom cover 330, and removable top cover 318 are all insulated. The material filling the heat transfer space 312 may be sand, or sand like material or a variety of suitable oils. In an alternative mode, the heat jacket 303 may be replaced in its entirety by electrical heating cables that wrap around the high pressure cylinder, or similarly by tubes conducting a heating fluid.

The solution to treat the artifact 319 is held in a reservoir 309. The solution flows 310 to a high pressure pump 306 and is delivered to the high pressure cylinder 302 at a point 329. The pressurized solution may pass through a preheating element 331, or it may be heated by function of the heat jacket 303. The solution is heated after it is pressurized. Pressure is maintained by the high pressure pump on the input side of the cylinder and by the function of a back pressure regulator 311 on the output side of the high pressure cylinder 302. Solution with drawn from the high pressure cylinder may pass through a heat exchange element exit 332 to help cool the solution prior to final discharge from the system into a receptacle 308.

The size (length 315 and diameter 314) of the high pressure cylinder has no theoretical limits. A first prototype capable of treating only a section of a rivet recovered from the "H. L. Hunley" included an Isco LC 5000 500 ml syringe pump, a 1.8 l solution reservoir, and an approximately 40 ml high pressure cylinder.

A second prototype utilized a lab Alliance Series 111 HPLC pump, a 4 l solution reservoir, and a 600 ml high pressure cell.

A high pressure cell large enough to receive for treatment the entire hull of the "H.L. Hunley" has an approximate 70,000 to 100,000 l (280,000 to 400,000 gal) capacity with a length of over 13 meters and a diameter of at least 3 meters.

The device illustrated in FIG. 3 is oriented in a vertical position. In practice, the device may be oriented as illustrated, or rotated 90 degrees to a horizontal position. As one skilled in the art recognizes, the change in orientation has no significant effect on the scope or intent of the invention and both vertical and horizontal orientations are anticipated by the invention.

Examples 1, 2, and 3 consider $Cl^{-1}$ ion removal from cast iron artifact. All samples are from a Parrott gun shell recovered from prolonged (more than 100 years) submergation in a marine environment. Example 4 is a wrought iron rivet from the hull of the "H.L. Hunley." The ultimately goal of the stabilization/preservation of marine artifact is to minimize loss of any structural material, even severely corroded remains. Thus, handling and preprocessing recovered material is minimized. After recovery, preprocessing may be limited to very gentle washing in water to soak-off mud and similar debris, concretion removal, and holding in a water tank to minimize exposure to oxygen.

Example 1

Figure 4:
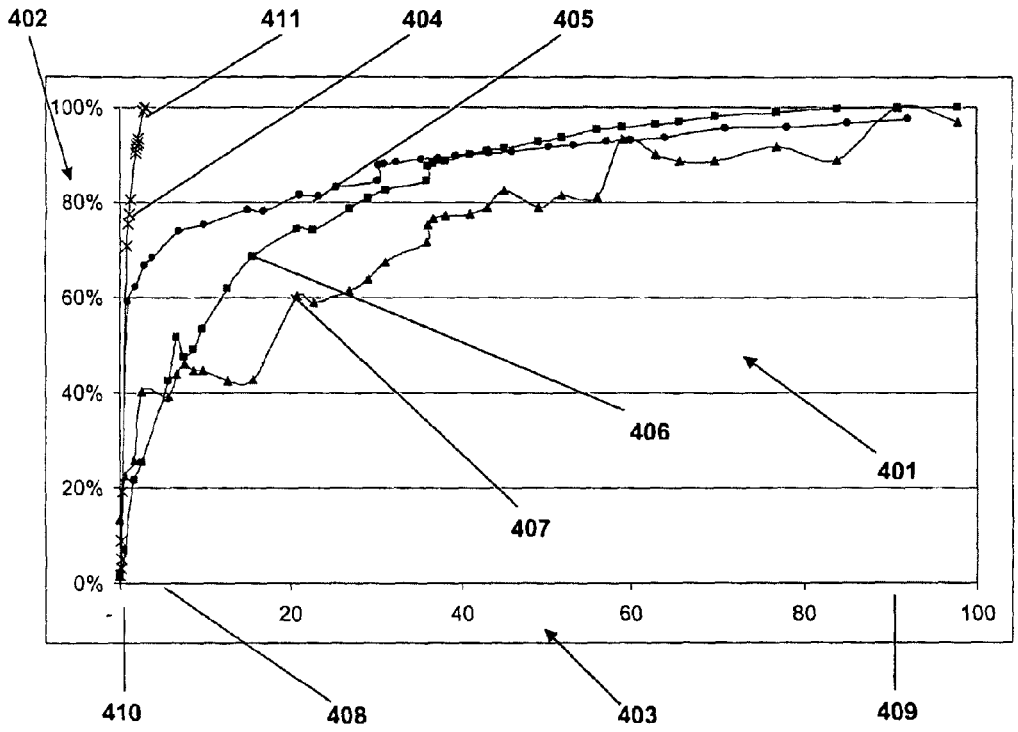
FIG. 4 shows removal of $Cl^{-1}$ from cast iron using a heated NaOH solution under pressure in comparison with other methods.

Removal of $Cl^{-1}$ ion in response to treatment with 0.50% NaOH solution heated to 130-230 C at 600-800 psi from cast iron recovered from a marine environment is summarized in FIG. 4 and compared with alternative treatments to remove the chloride ion. The percent of total $Cl^{-1}$ released from a section of a Parrot gun shell recovered from an environment comparable to the environment from which the H.L. Hunley was recovered is shown for four removal treatments for a maximum 90 day treatment period 401. Fraction of total $Cl^{-1}$ 402 is indicated on the vertical axis, ranging from "0" (at time "0") 410 to 100%. Time in days 403 is indicated on the horizontal axis ranging from "0" 410 to 90 days 409.

The most rapid removal was achieved with heated NaOH solution under pressure 404. Maximum removal 411, expressed as 100%, was achieved in less than 3 days 408. In terms of rate of removal, all other treatments are clearly inferior: NaOH with electrolysis 405, soaking in NaOH 406, and soaking in $Na_2CO_3$ (5% w/w) 406. For these three, chloride removal continued for 90 days.

Rate of $Cl^{-1}$ removal is of significant importance to the stabilization and preservation of artifact recovered from marine environments because of its continued potential corrosive activity.

Example 2

Figure 5:
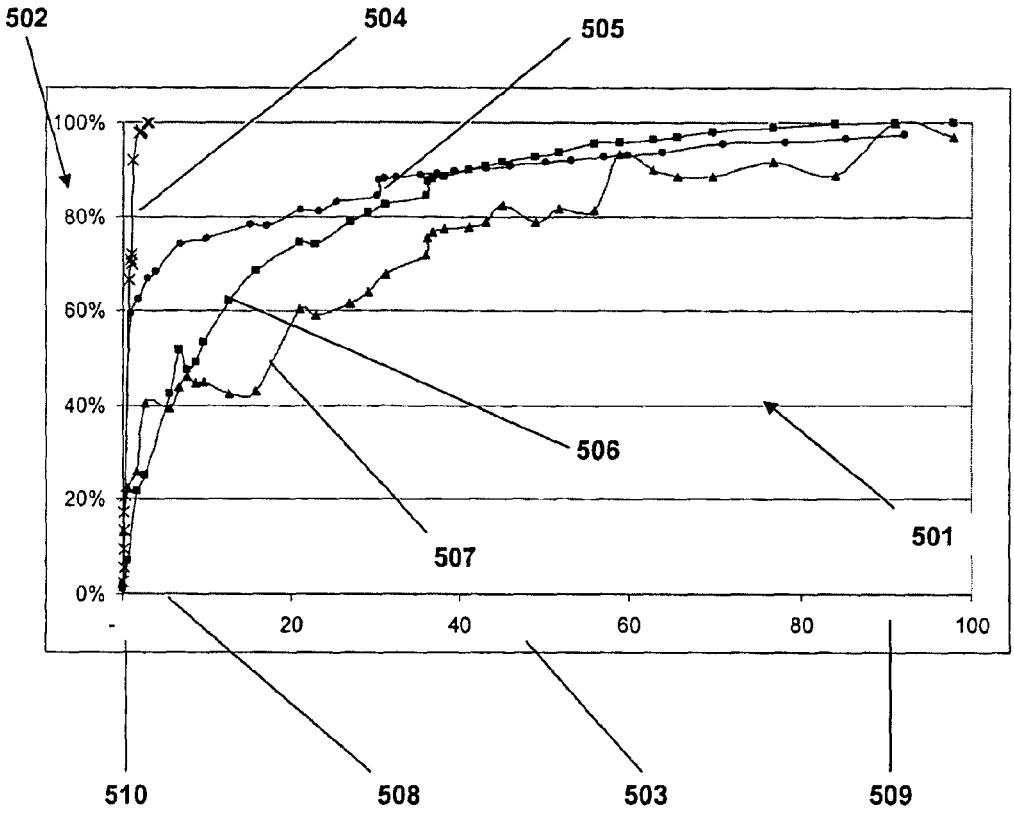
FIG. 5 shows removal of $Cl^{-1}$ from cast iron using heated $NH_4OH$ solution under pressure in comparison with other methods.

FIG. 5 illustrates 501 the fraction of total $Cl^{-1}$ removed 502 from a cast iron artifact (a Parrot gun shell) over time in days 503 for a maximum period of 90 days using a 0.10% (w/w) solution of ammonium hydroxide ($NH_4OH$) at 180 C and 600-800 psi 504 (conditions comparable to those described for Example 1 as shown in FIG. 4). The response 504 is compared with soaking in a 5% (w/w) solution of sodium bicarbonate ($Na_2CO_3$) 507, soaking in a 1% (w/w) sodium hydroxide solution (NaOH) 506, and soaking in NaOH followed by electrolysis 505. The heated alkaline solution under pressure 504 resulted in essentially 100% removal of chloride ion in two days 508. The other solutions and treatment combinations ultimately resulted in nearly complete removal of $Cl^{-1}$, but removal required up to 90 days 509.

Comparing the effects of subcritical solution conditions (temperature and pressure) on the rate of complete $Cl^{-1}$ ion removal 404 (NaOH) and 504 ($NH_4OH$ with other treatments establishes that heated alkaline solutions at pressures that combined with the temperature represent a subcritical phase of the solution greatly accelerate the rate of $Cl^{-1}$ removal, and this is highly desirable in stabilizing and preserving metal (iron) artifact.

Example 3

Using an alkaline solution heated under pressure (subcritical conditions) enhanced the rate of $Cl^{-1}$ removal and tended to preserve corroded materials and stabilized the recovered artifact. Such treatment reduced damage from continued corrosion even in the relatively short periods of time to effect complete chloride ion removal (2 to 3 versus up to 90 days).

Figure 6A:
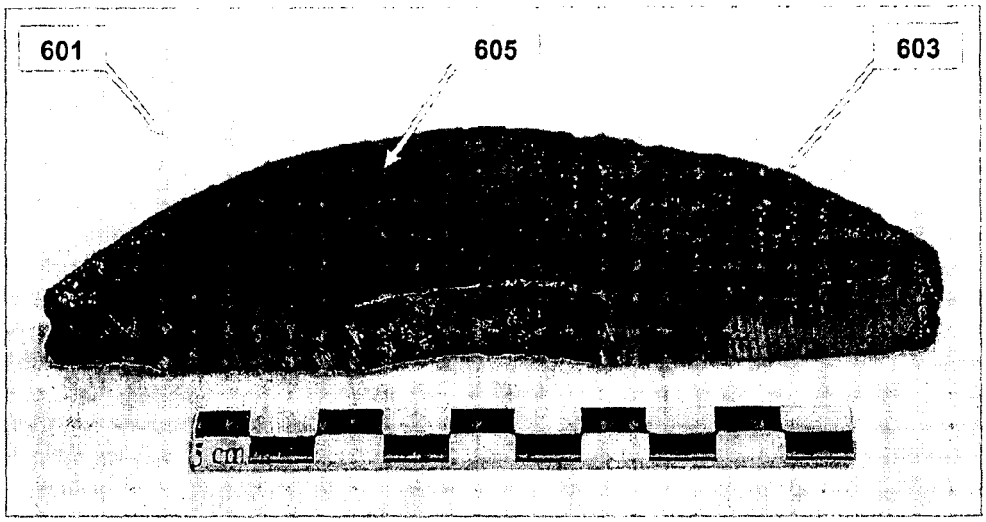
FIG. 6A is a photograph of a section sliced from a cast iron, Parrot gun shell prior to treatment with a heated, alkaline solution under pressure.
Figure 6B:
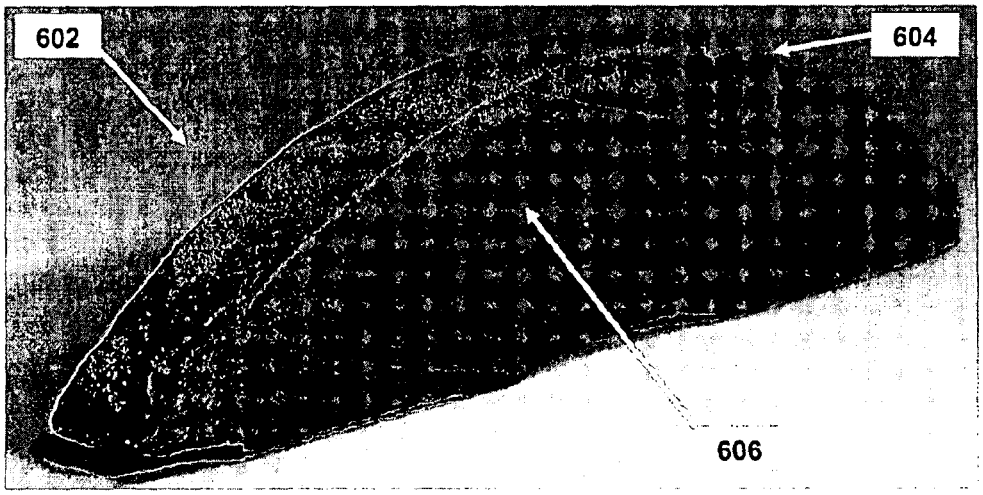
FIG. 6B is a photograph of the artifact in FIG. 6A following treatment with a heated, alkaline solution under pressure.

FIG. 6A illustrates photographically the impact of long-term corrosion on cast iron. The specimen 601 is a section of a Civil War era Parrot gun shell recovered from a marine environment and untreated, except for initial pre-treatment comprising no more than rinsing mud and related debris from the object. An outer perimeter area 603 reveals the destructive impact of corrosive forces with visible changes in the structure of the cast iron material. The more protected, interior portion of the specimen 605 illustrates natural, or un-corroded structure of the cast iron. FIG. 6B is a photograph 602 of the same specimen of FIG. 6A, 601, taken after the specimen 602 was treated with heated NaOH under pressure for two days. Although the treatment effectively removed all $Cl^{-1}$ ions, thereby effectively stopping the corrosive processes, the treatment did not alter the visibly damaged structure 604 or change the more interior material 606.

Figure 7A:
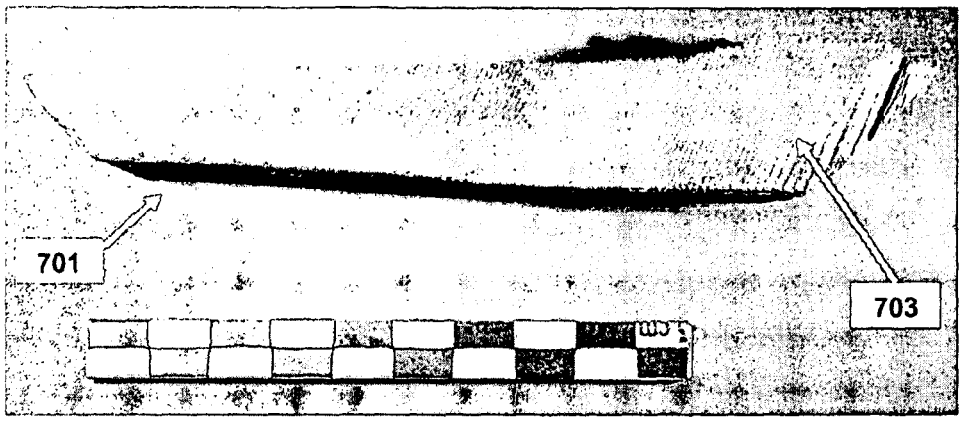
FIG. 7A is a photograph of cast iron artifact before treatment with a heated, alkaline solution under pressure.
Figure 7B:
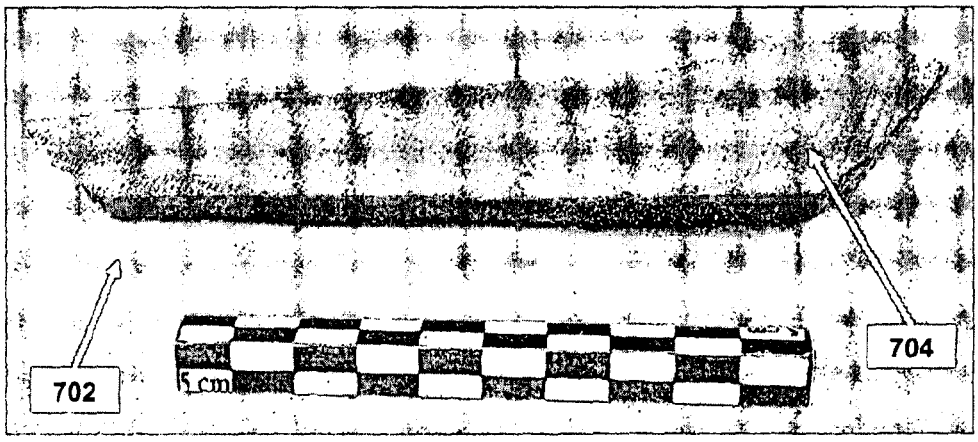
FIG. 7B is a photograph of the artifact in FIG. 7A 8 months following treatment with a heated alkaline solution under pressure.

Effective $Cl^{-1}$ removal affords long-term protection against continued corrosive forces. FIG. 7A illustrates 701 a section of a Civil War era Parrott gun shell recovered from a marine environment with $Cl^{-1}$ removed by treatment with a heated alkaline solution under pressure for two days. Details of the preserved metal are clearly visible 703. FIG. 7B is a photograph 702 of the specimen 701 of FIG. 7A taken eight months following removal of the $Cl^{-1}$. Structural details 704 remain clear, and no structural changes or defects attributable to $Cl^{-1}$ related corrosion are apparent.

Figure 8:
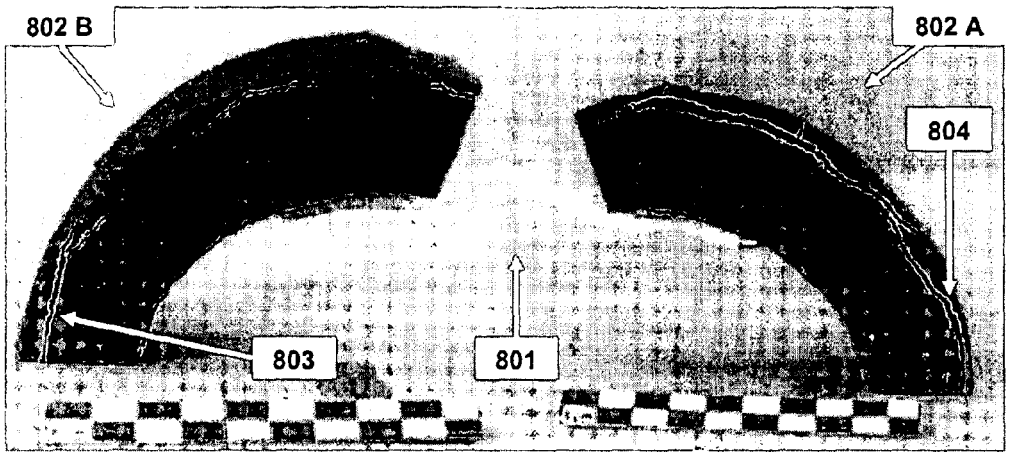
FIG. 8 is a photograph of cast iron artifact 30 days following soaking in a dilute NaOH solution.

FIG. 8 illustrates 801 one of the major problems often encountered in the treatment of cast iron using electrolysis. The two segments 802A and 802B of a Parrot gun shell are comparable to the specimens of FIGS. 6A, 6B, 7A, and 7B. The specimen 801 was treated by soaking in a 1% (w/w) solution of NaOH followed by electrolysis, a recognized method of $Cl^{-1}$ removal. The specimen 801 clearly illustrates major cracks 803 and 804 formed during the day treatment period using NaOH/electrolysis treatment. The formation of the cracks 803 and 804 reflect effective destruction of the artifact. Complete and rapid removal of $Cl^{-1}$ ions affords long term protection against continued corrosion as illustrated for example in comparison of the specimen in FIG. 7A versus 7B.

Example 4

Samples of rivets from the hull of the L.H. Hunley provide the basis of evaluating various systems and methods of $Cl^{-1}$ removal from wrought iron artifact recovered from a marine environment. Compared to the relatively more plentiful supply of cast iron from Parrot gun shells, the supply of rivet material (wrought iron) from the hull of the L.H. Hunley (FIG. 1) was relatively limited in the interest of maximum preservation of the intact artifact. Individual rivets to be removed from the hull and used in $Cl^{-1}$ removal studies were identified and the location of each cataloged. Individual rivets were removed by drilling, a method well appreciated by those skilled in the art.

Figure 9:
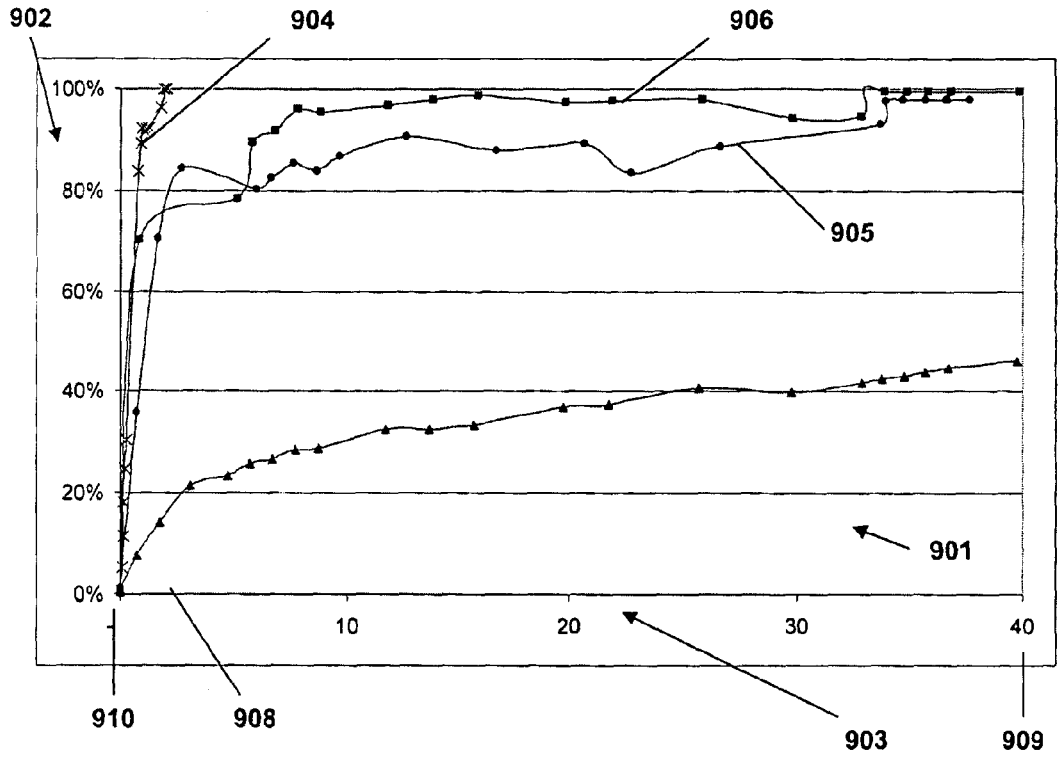
FIG. 9 shows removal of $Cl^{-1}$ from wrought iron artifact using heated, alkaline solution under pressure in comparison with other methods.

FIG. 9 illustrates 901 the fraction of $Cl^{-1}$ removed 902 over time 903 in days for a maximum of 40 days, using a 0.05% (w/w) solution of NaOH heated to 18° C. at 600 to 800 psi 904, compared to soaking in NaOH followed by electrolysis 905, soaking in 1.0% (w/w) solution of NaOH 906, or soaking in a 5.0% solution (w/w) $Na_2CO_3$ 907. Although nearly full (100%) removal was achieved by for the NaOH soaking 906, full removal of $Cl^{-1}$ ions was achieved most rapidly (in two days 908) with the heated NaOH solution under pressure 904. The $Na_2CO_3$ solution 907 was markedly inferior in terms of rate of chloride removal.

Figures 10A, 10B:
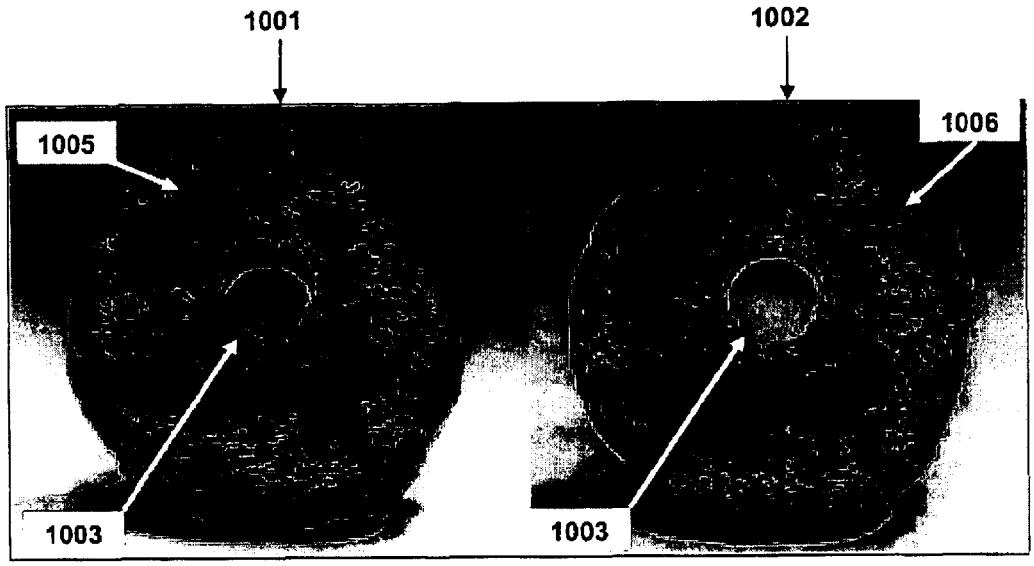
FIG. 10A is a photograph of wrought iron artifact before treatment with a heated alkaline solution under pressure.
FIG. 10B is a photograph of the artifact in FIG. 10A following treatment with a heated alkaline solution under pressure.

FIG. 10A illustrates a portion of a rivet 1001 removed from the hull of the H.L. Hunley prior to any treatment to remove $Cl^{-1}$ ions. The hole 1003 was drilled as a step in removing the rivet from the hull. The only pre-treatment of the specimen was washing in tap water to remove debris. Details 1005 of the severely corroded metal are obvious. FIG. 10B is a photograph of the specimen 1002 shown in FIG. 10A 1001 following treatment with heated NaOH under pressure. As shown in FIG. 9, $Cl^{-1}$ is rapidly accomplished by this 904 treatment. As is obvious from FIG. 10B, treatment to remove the $Cl^{-1}$ ions did not alter or distort the surface appearance of the artifact (rivet) 1006. The removal process apparently preserved the structure 1005 as it appeared in the recovered artifact.

The preceding examples, figures, discussion and explanations consider specific materials and conditions. It is to be understood that such specific details are given for illustrative purposes and not as limitations to be applied in interpreting the appended claims.

What is claimed is:

1. A method to remove rapidly chloride ions from corroded, iron, archeological artifacts comprising the steps of:

identifying the artifact from which chloride ions are to be removed;

recovering said artifact;

pre-treating said recovered artifact by washing to remove debris and any concretion, and positioning said artifact in a container for treatment;

preparing a dilute alkaline solution;

next, filling said container with an adequate volume of said dilute alkaline solution;

then pressurizing said container to a predetermined level to maintain said dilute alkaline solution at a sub-critical phase;

then, heating said dilute alkaline solution in said pressurized cylinder to at or above 130° C. and maintaining said pressure to hold said dilute alkaline solution at a sub-critical phase;

circulating said alkaline solution in said container to ensure maximum contact with said artifact for a period of time adequate to remove the chloride ions; and, cooling and discharging said alkaline solution and recovering said artifact from said container.

2. The method of claim 1 wherein said dilute alkaline solution is a dilute solution of NaOH.

3. The method of claim 1 wherein said dilute alkaline solution is preheated.

4. A method to remove chloride ions from corroded iron comprising the steps of:

placing an iron object within a treatment vessel;

adding a volume of a dilute alkaline solution to said treatment vessel;

pressuring said container to a predetermined pressure level adequate to establish, after a heating step, a sub-critical phase;

following said pressurizing said container step, heating the diluted alkaline solution to a predetermined temperature while maintaining said predetermined pressure level, thereby establishing a sub-critical phase of the dilute alkaline solution;

maintaining said sub-critical phase conditions of a predetermined pressure and a predetermined temperature level until a desired amount of removed chloride ions is achieved.

* * * * *

UNITED STATES PATENT AND TRADEMARK OFFICE

CERTIFICATE OF CORRECTION

PATENT NO. : 8,535,447 B2
APPLICATION NO. : 13/330104
DATED : September 17, 2013
INVENTOR(S) : Drews It is certified that error appears in the above-identified patent and that said Letters Patent is hereby corrected as shown below:

On the Title page, item 12, Drew should read: Drews

On the Title page, item 75, Inventor should read: Michael J. Drews, Clemson, SC

Signed and Sealed this
Sixteenth Day of June, 2015

Michelle K. Lee

Michelle K. Lee
*Director of the United States Patent and Trademark Office*